US012631337B1

(12) United States Patent
Wu

(10) Patent No.: US 12,631,337 B1
(45) Date of Patent: May 19, 2026

(54) PORTABLE WOOD STOVE

(71) Applicant: Wuyi Migo Leisure Products Co., Ltd, Jinhua (CN)

(72) Inventor: Peiwu Wu, Wuhu (CN)

( * ) Notice: Subject to any disclaimer, the term of this patent is extended or adjusted under 35 U.S.C. 154(b) by 0 days.

(21) Appl. No.: 19/331,534

(22) Filed: Sep. 17, 2025

(30) Foreign Application Priority Data

Aug. 18, 2025 (CN) ..... 202521755105.8
Sep. 5, 2025 (CN) ..... 202521911787.7

(51) Int. Cl.
*F24C 15/08* (2006.01)
*F24B 1/182* (2006.01)
*F24B 1/19* (2006.01)
*F24C 1/16* (2021.01)

(52) U.S. Cl.
CPC ..... *F24B 1/182* (2013.01); *F24B 1/19* (2013.01); *F24C 1/16* (2013.01); *F24C 15/08* (2013.01)

(58) Field of Classification Search
CPC .... F24B 1/182; F24B 1/19; F24B 3/00; F24B 1/202; F24B 1/205; F24B 1/181; F24C 1/16; B65D 7/28
USPC ..... 126/9 R
See application file for complete search history.

(56) References Cited

U.S. PATENT DOCUMENTS 1,221,514 A * 4/1917 Crain ..... F24B 1/205 126/29
1,297,564 A * 3/1919 Harris, Jr. ..... B65D 9/12 217/44
1,372,424 A * 3/1921 Haase ..... F23G 7/10 110/241
2,614,553 A * 10/1952 Cox et al. ..... F24B 13/04 126/73
3,361,093 A * 1/1968 Heitz ..... F23G 5/42 126/59.5
3,494,349 A * 2/1970 Allen ..... A47J 37/0786 126/25 B
5,682,872 A * 11/1997 Whitted ..... F24B 1/003 126/25 B
6,425,387 B1 * 7/2002 Rohback, Jr. ..... F24B 1/205 126/152 A
10,222,092 B1 * 3/2019 Traeger ..... F24B 3/00
10,669,094 B1 * 6/2020 Mulder ..... B65D 88/744
D1,003,646 S * 11/2023 Vargo ..... D7/332
(Continued)

FOREIGN PATENT DOCUMENTS

CN 216814230 U 6/2022
CN 217178579 U 8/2022
(Continued)

*Primary Examiner* — Jorge A Pereiro
(74) *Attorney, Agent, or Firm* — Nitin Kaushik

(57) ABSTRACT

Disclosed in the present disclosure is a portable wood stove, including a foldable main unit, a top plate, and a base. The main unit is composed of a plurality of groups of mounting plates that are adjacently connected and mutually rotate. An upper end, a hollow chamber and a lower end of the main unit run through one another. When the main unit is in a completely folded state, the hollow chamber inside forms a first storage chamber. When the top plate and the base are placed in the first storage chamber, at least a portion of structures of the top plate and the base is located in the first storage chamber. When the main unit is in a completely unfolded state, a second storage chamber is formed by an area among the main unit, the top plate and the base.

6 Claims, 8 Drawing Sheets

(56) References Cited

U.S. PATENT DOCUMENTS

| | | | | | |
|---|---|---|---|---|---|
| D1,046,541 | S * | 10/2024 | Zhang | D7/332 | |
| 12,385,643 | B1 * | 8/2025 | Weilert | F24B 1/198 | |
| D1,098,394 | S * | 10/2025 | Bian | D23/332 | |
| 2004/0020484 | A1 * | 2/2004 | Skidmore | A47J 37/0763 | 126/304 R |
| 2005/0178060 | A1 * | 8/2005 | Weder | A47G 7/085 | 47/72 |
| 2008/0236573 | A1 * | 10/2008 | Fehr | F24B 1/024 | 126/9 A |
| 2008/0271371 | A1 * | 11/2008 | Weder | A01G 9/026 | 47/66.4 |
| 2012/0260904 | A1 * | 10/2012 | Russell | F24B 1/192 | 126/25 R |
| 2014/0238378 | A1 * | 8/2014 | Scott | F24B 1/181 | 126/55 |
| 2020/0096199 | A1 * | 3/2020 | Harrington | F24B 5/025 | |

FOREIGN PATENT DOCUMENTS

| | | | | | |
|---|---|---|---|---|---|
| CN | 222210740 | U | 12/2024 | | |
| KR | 2363681 | B1 * | 2/2022 | | |
| KR | 20240066599 | A * | 5/2024 | A47J 37/0763 | |
| WO | WO-2010052667 | A2 * | 5/2010 | F23B 10/02 | |
| WO | WO-2025108505 | A1 * | 5/2025 | A47J 37/07 | |

* cited by examiner

PORTABLE WOOD STOVE

CROSS-REFERENCE TO RELATED APPLICATIONS

The application claims priority to Chinese patent application No. 2025217551058, filed on Aug. 18, 2025, the entire contents of which are incorporated herein by reference.

TECHNICAL FIELD

The present disclosure relates to the field of outdoor cooking utensils, in particular to a portable wood stove.

BACKGROUND

In today's context of continuous innovation in outdoor supplies technology, various innovative products are emerging in an endless stream to meet people's growing demand for outdoor life. As an important tool for outdoor cooking, the portability and functionality of wood stoves have always been the key points of research and development. In the document with Patent No. CN106705125A, a portable wood stove is disclosed. The original intention of designing this portable wood stove is mainly focused on solving the problem of outdoor carrying. It adopts a unique method of component separation and nested storage to reduce its own volume. By reasonably splitting the various components of the wood stove and then using a nested storage form, these components can be tightly and orderly combined together, thereby significantly reducing the space occupied by the entire wood stove. However, the realization of its functions depends on other components, such as a blower, which means that users must carry additional blowers and other accessories when carrying a wood stove. This not only increases the number and weight of objects carried, but also increases the losing and damaging risk of the objects, which to some extent weakens the portability advantage that was originally emphasized. In addition, the cumbersome assembly and disassembly steps of the wood stove are also a problem that cannot be ignored, so it is impossible to balance portability and functionality.

SUMMARY

The present disclosure addresses the deficiencies in the prior art and provides a portable wood stove, including:

- a foldable main unit, where the main unit is composed of a plurality of groups of mounting plates that are adjacently connected and mutually rotate, the main unit has a combustion chamber, and the combustion chamber is defined inwardly by the mounting plates;
- a top plate arranged at an upper portion of the main unit and detachably connected to the main unit, where a support table for supporting an object to be heated is provided at an upper portion of the top plate, and an opening portion is arranged at the upper portion of the top plate; and
- a base arranged at a lower portion of the main unit and detachably connected to the main unit, wherein
- an upper end and a lower end of the main unit are configured as opening structures; the upper end, a hollow chamber, and the lower end of the main unit run through one another; when the main unit is in a completely folded state, the hollow chamber inside forms a first storage chamber; when the top plate and the base are placed in the first storage chamber, at least a portion of structures of the top plate and the base is located in the first storage chamber; and when the main unit is in a completely unfolded state, a second storage chamber is formed by an area among the main unit, the top plate and the base, which is used for combustion of combustion materials.

Preferably, a mounting area is provided at a bottom of the top plate, and the top plate abuts against an upper end portion of the main unit through the mounting area and is sleeve-connected to the top plate. A supporting area is provided at a top of the base, and a lower end portion of the main unit abuts against an inside of the supporting area of the base and is sleeve-connected to the base.

Preferably, the portable wood stove further includes a support leg assembly arranged below the base, a ventilation area is formed between a bottom of the support leg assembly and a bottom of the base, a base air inlet hole is provided at the bottom of the base, and the ventilation area and the base air inlet hole communicate with each other to form an air inlet channel for full combustion of firewood in the stove.

Preferably, when the main unit is completely folded, the top plate and the base are separated from the main unit. When the first storage chamber performs storage, an outer side wall of the main unit abuts against a supporting medium, and the top plate and the base extend into the first storage chamber through the opening structure for storage.

Preferably, when the main unit is completely unfolded, the top plate abuts against the upper portion of the main unit, and the lower portion of the main unit abuts against the base to form a stove. The stove abuts against the supporting medium through the support leg assembly, and the combustion materials are placed in the second storage chamber through the opening portion of the top plate or the opening structure of the main unit.

Preferably, the mounting plate includes an inner side plate and an outer side plate that are detachably connected, and a circumferential area of an inner wall of the inner side plate forms an enclosing portion that wraps the combustion materials for full combustion of the combustion materials. A gap is formed between the outer side plate and the inner side plate to form an air inlet channel for secondary combustion.

Preferably, the inner side plate includes a first plate body and connecting portions respectively extending along both sides of the first plate body, the connecting portions are distributed along a length direction and there is at least one connecting portion. The connected inner side plates are rotationally connected to the connecting shaft along the length direction through the connecting portions so that adjacently arranged inner side plates are rotationally connected to each other. The connecting shaft runs through the entire height of the inner side plate and is equivalent to the height of the inner side plate. The first plate body has a first inner wall portion, a first outer wall portion, and a first side portion having two sides. The combustion chamber is composed of chambers formed inwardly by the several first inner wall portions. After the inner side plate and the connecting shaft are connected and rotate relative to each other, the main unit forms a folded state and an unfolded state. When the main unit is in the completely folded state and the completely unfolded state, a gap between the first side portion of the inner side plate and the connecting shaft forms a first anti-interference area.

Preferably, the outer side plate is located outside the first outer wall portion of the inner side plate, the outer side plate includes a second plate body and a barrier, the second plate body has a second inner wall portion, a second outer wall portion, and a second side portion having two sides, the barrier is formed by protruding from the second inner wall portion, and the outer side plate is connected to the inner side plate through the second plate body or the barrier is connected to the first plate body of the inner side plate. The air inlet channel is formed by a through space between the first outer wall portion and the second inner wall portion.

Preferably, the outer side plate further includes a supporting portion formed from flanges of the second side portion, and the supporting portion has an outer side portion. After the outer side plate and the inner side plate are connected and rotate as a whole relative to the connecting shaft, the main unit forms a folded state and an unfolded state. When the main unit is in a completely folded state or a completely unfolded state, a gap between the second side portion of the outer side plate or the outer side portion of the supporting portion and the connecting shaft forms a second anti-interference area.

Preferably, a lower secondary air inlet hole is provided on a lower side wall of the outer side plate, an upper secondary air inlet hole is provided on an upper side wall of the inner side plate, and an area from the lower secondary air inlet hole to the air inlet channel to the upper secondary air inlet hole forms a secondary heating channel of a combustion-supporting stove.

In summary, the present disclosure has the following beneficial effects.

The portable wood stove disclosed by the present disclosure includes a foldable main unit, a top plate, and a base, where the main unit is composed of a plurality of groups of mounting plates that are adjacently connected and mutually rotate, the main unit has a combustion chamber, and the combustion chamber is defined inwardly by the mounting plates; the top plate is arranged at an upper portion of the main unit and is detachably connected to the main unit, a support table for supporting an object to be heated is provided at an upper portion of the top plate, and an opening portion is arranged at the upper portion of the top plate; the base is arranged at a lower portion of the main unit and is detachably connected to the main unit; an upper end and a lower end of the main unit are configured as opening structures; the upper end, a hollow chamber, and the lower end of the main unit run through one another; when the main unit is in a completely folded state, the hollow chamber inside forms a first storage chamber; when the top plate and the base are placed in the first storage chamber, at least a portion of structures of the top plate and the base is located in the first storage chamber; and when the main unit is in a completely unfolded state, a second storage chamber is formed by an area among the main unit, the top plate and the base, which is used for combustion of combustion materials. The design of the opening portion allows the heat generated by combustion to be better transferred to the object to be heated, thereby improving the heat transfer efficiency. At the same time, the opening portion can also play a certain ventilation role, thereby facilitating the air circulation in the combustion chamber and promoting the full combustion of the combustion materials. By folding the first storage chamber, the volume of the wood stove is compressed, making it easy to carry. The second storage chamber formed by unfolding meets functional needs, provides sufficient combustion space, stabilizes the combustion environment, and improves the combustion effect, thereby achieving a balance between portability and functionality.

BRIEF DESCRIPTION OF DRAWINGS

The drawings described herein are used to provide further understanding of the present disclosure and constitute a portion of the present application. The exemplary embodiments of the present disclosure and their descriptions are used to explain the present disclosure and do not constitute improper limitations on the present disclosure.

Figure 1:
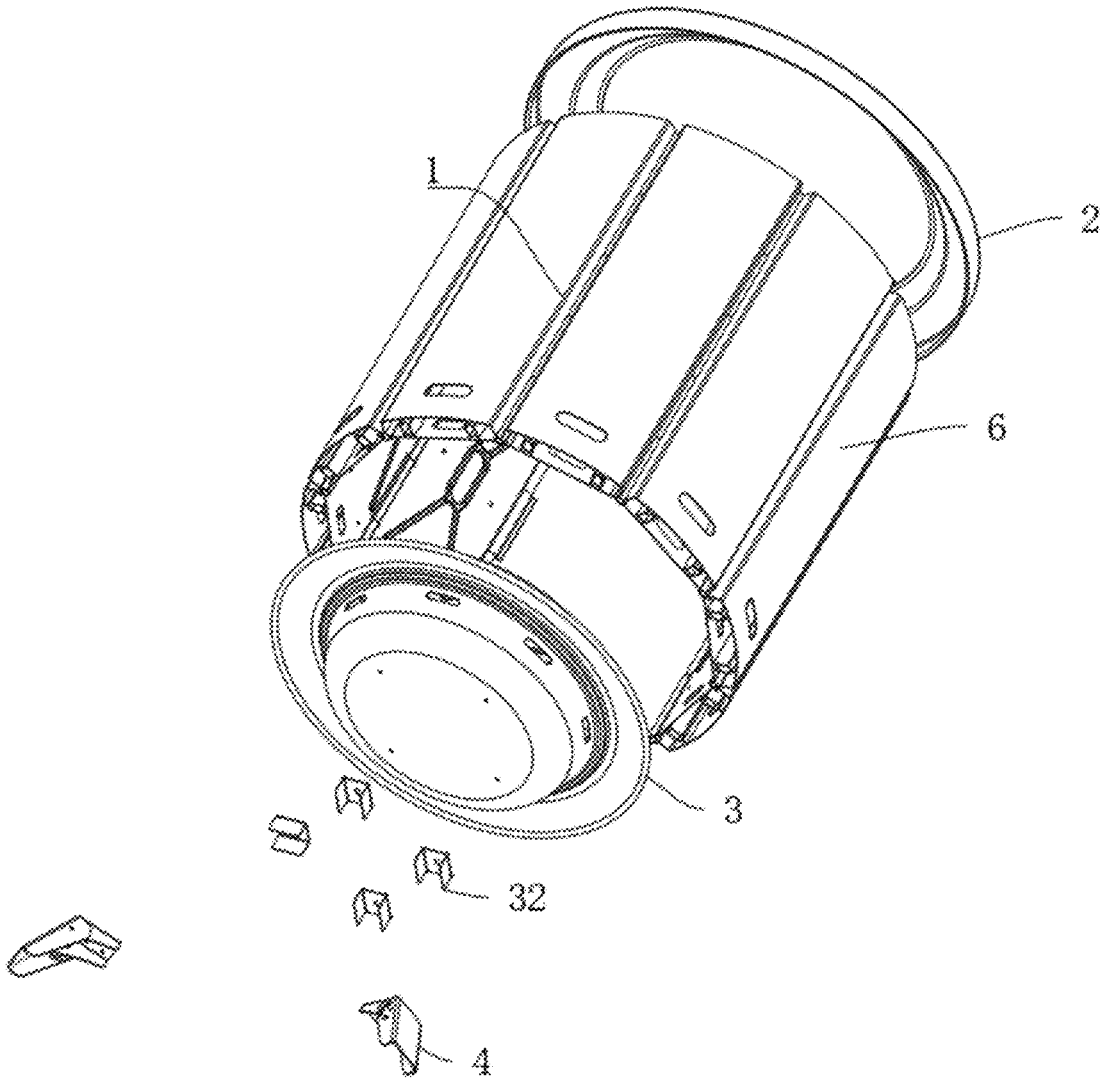
FIG. 1 is a schematic diagram of an overall exploded structure according to the present disclosure.

Description of reference signs: 1. Main unit; 2. Top plate; 21. Support table; 3. Base; 31. Base air inlet hole; 32. Supporting area; 4. Support leg assembly; 5. Inner side plate; Connecting portion; 52. Upper secondary air inlet hole; 6. Outer side plate; 61. Barrier; 62. Lower secondary air inlet hole; 7. Connecting shaft.

DETAILED DESCRIPTION OF THE EMBODIMENTS

To make the objectives, technical solutions and advantages of the embodiments of the present disclosure clearer, the technical solutions of the embodiments of the present disclosure is clearly and completely described below with reference to the accompanying drawings of the embodiments of the present disclosure. Obviously, the described embodiments are only portion of the embodiments of the present disclosure, rather than all the embodiments. Based on the described embodiments of the present disclosure, all other embodiments obtained by those skilled in the art without creative work shall fall within the scope of protection of the present disclosure.

In descriptions of the present disclosure, it should be understood that, if orientation or positional relationships indicated by terms "upper", "lower", "front", "back", "left", "right", "top", "bottom", "inside", "outside", and the like, are based on the orientation or positional relationships shown in the accompanying drawings, and the terms are merely intended to facilitate the descriptions of the present disclosure and simplify the descriptions, rather than indicating or implying that a device or assembly referred to must have a specific orientation. With construction and operation in a specific direction, the terms therefore should not be understood as limiting the present disclosure.

In the present disclosure, unless otherwise expressly specified or limited, the terms "installed", "connected", "connection", "fixed" and the like should be understood in a broad sense, for example, it can be a fixed connection, a detachable connection, or an integral connection. It can be a mechanical connection or an electrical connection. It can be directly connected, and can also be indirectly connected through an intermediate medium, or it can be the communication between the insides of two elements. For those skilled in the art, the specific meanings of the above terms in the present disclosure can be understood according to specific circumstances.

In the present disclosure, unless otherwise clearly stipulated and limited, the first feature being "on" or "under" the second feature may include the first and second features being in direct contact, or the first and second features not being in direct contact but being in contact through another feature between them. Moreover, the first feature being "on", "above" and "over" the second feature includes the first feature being directly above and obliquely above the second feature, or simply indicates that the first feature is at a higher level than the second feature. The first feature being "under", "below" or "beneath" the second feature includes the first feature is directly below or obliquely below the second feature, or simply indicates that the first feature is at a smaller level than the second feature.

Unless otherwise defined, technical or scientific terms used herein shall have the ordinary meaning as understood by one of ordinary skill in the art to which the present disclosure belongs. The terms "first", "second" and similar terms used in the patent application specification and claims of the present disclosure do not indicate any order, quantity or importance, but are only used to distinguish different components. Likewise, the words "a" or "an" and the like do not denote a limitation of quantity, but rather denote the presence of at least one.

Figure 2:
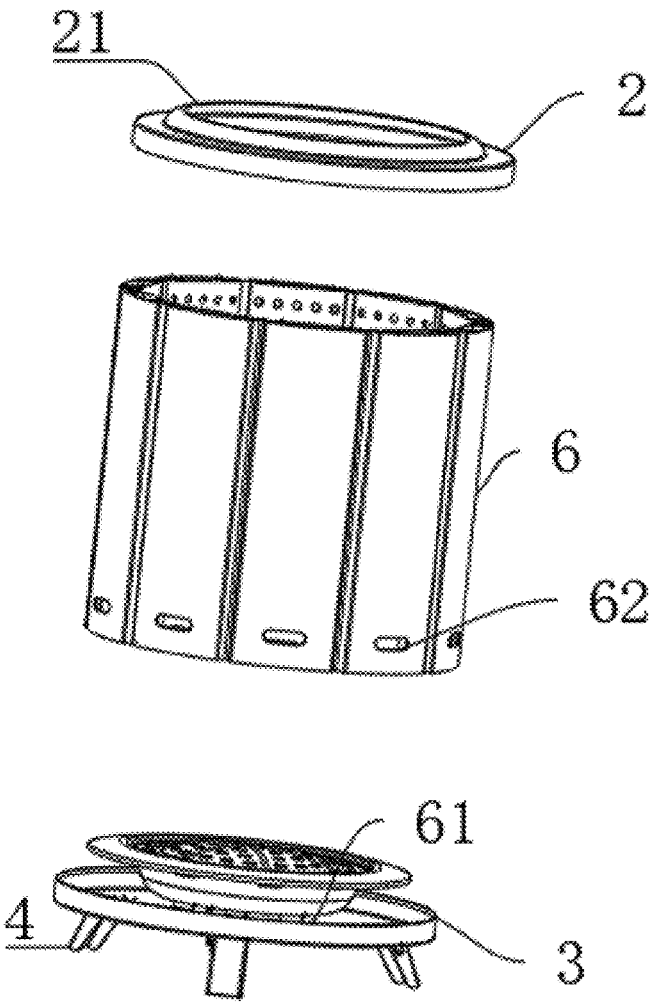
FIG. 2 is a schematic structural diagram of a main unit according to the present disclosure.
Figure 3:
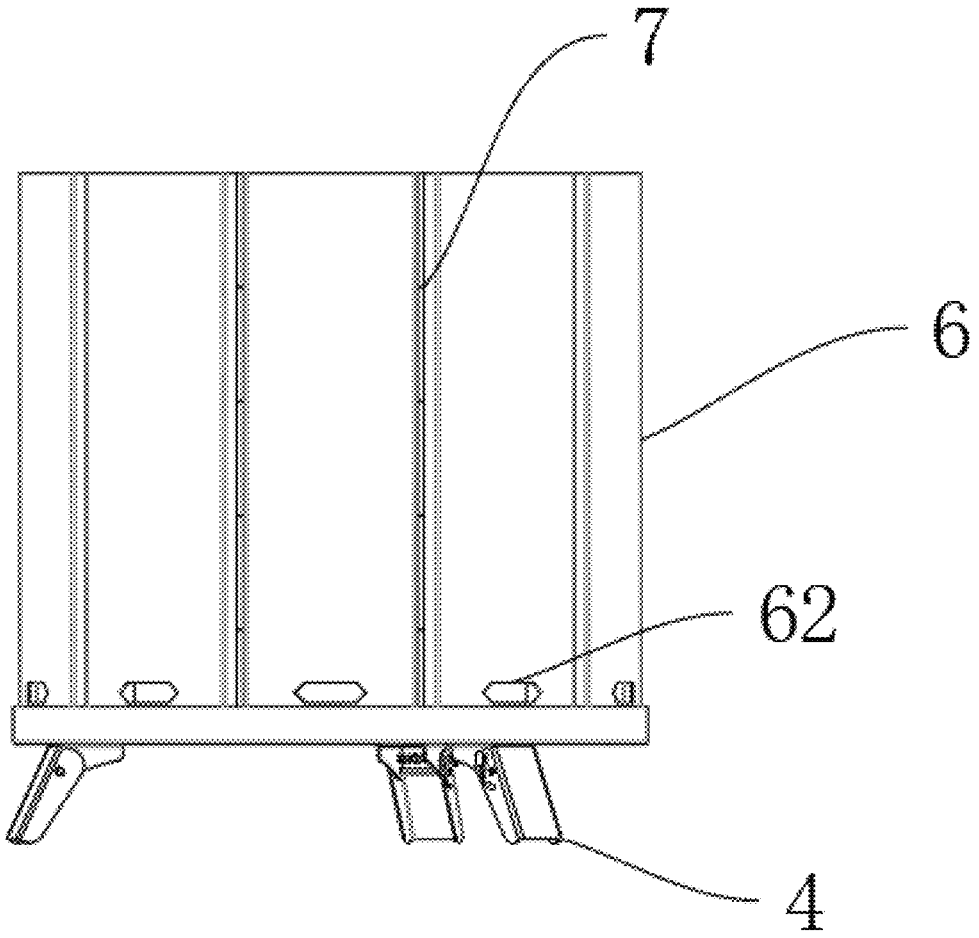
FIG. 3 is a schematic structural diagram of a main unit according to the present disclosure.
Figure 4:
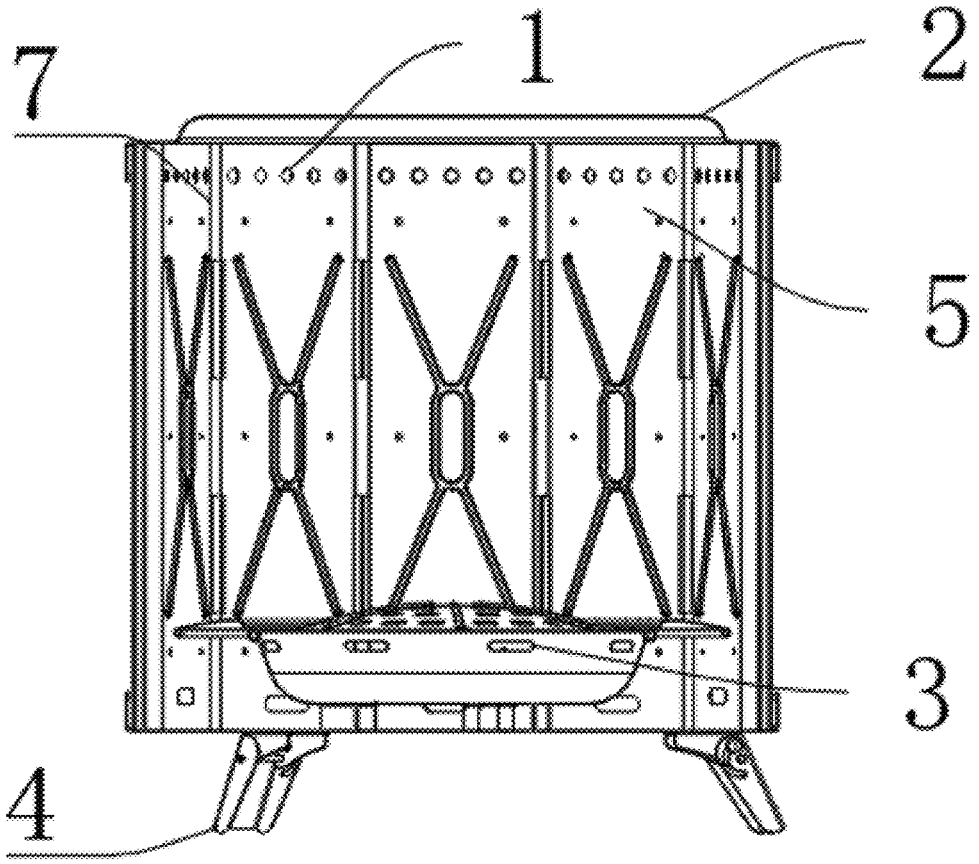
FIG. 4 is a cross-sectional schematic diagram of a main unit according to the present disclosure.
Figure 5:
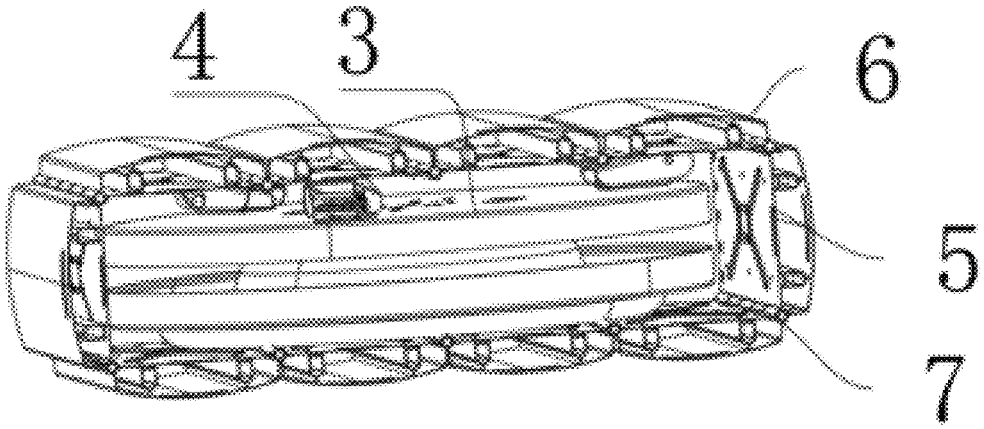
FIG. 5 is a folding schematic diagram of a main unit according to the present disclosure.
Figure 6:
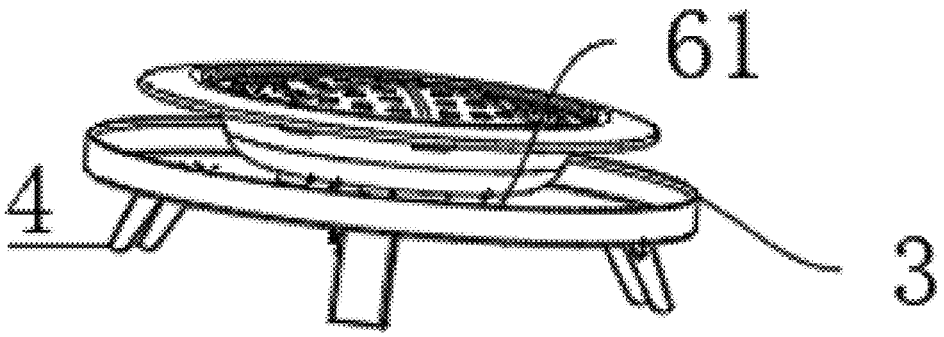
FIG. 6 is a schematic structural diagram of a base according to the present disclosure.
Figure 7:
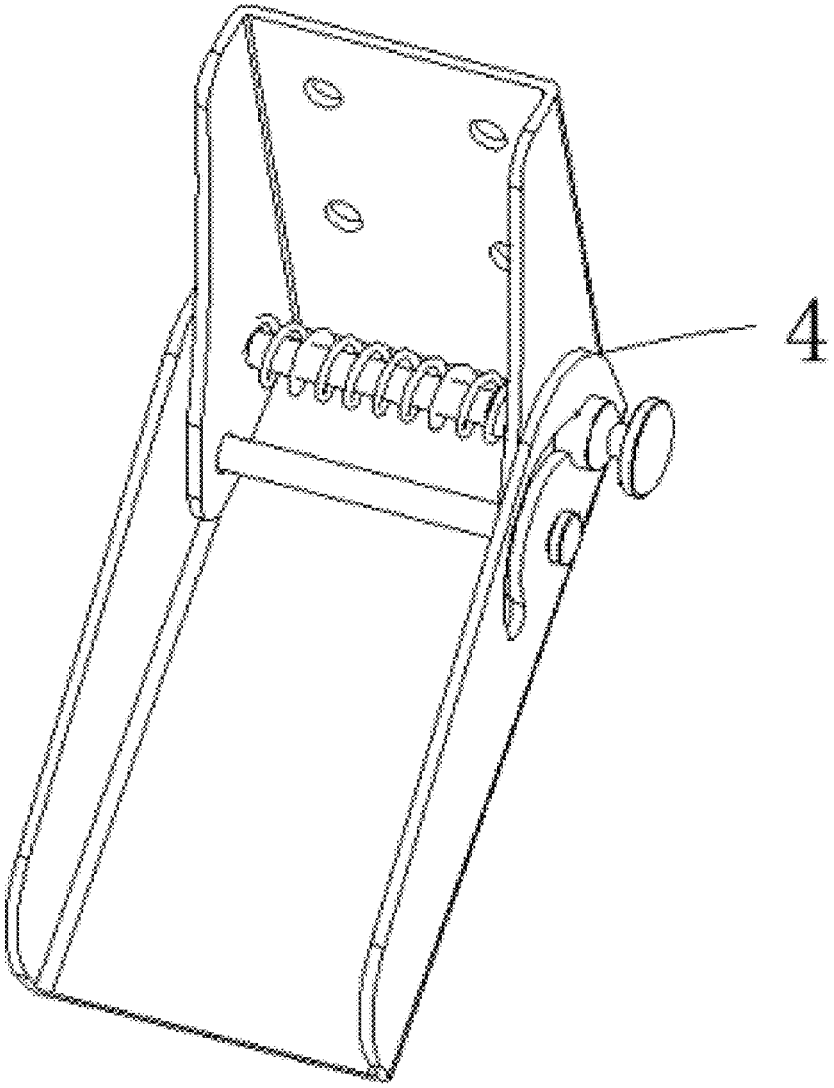
FIG. 7 is a schematic structural diagram of a support leg assembly according to the present disclosure.
Figure 8:
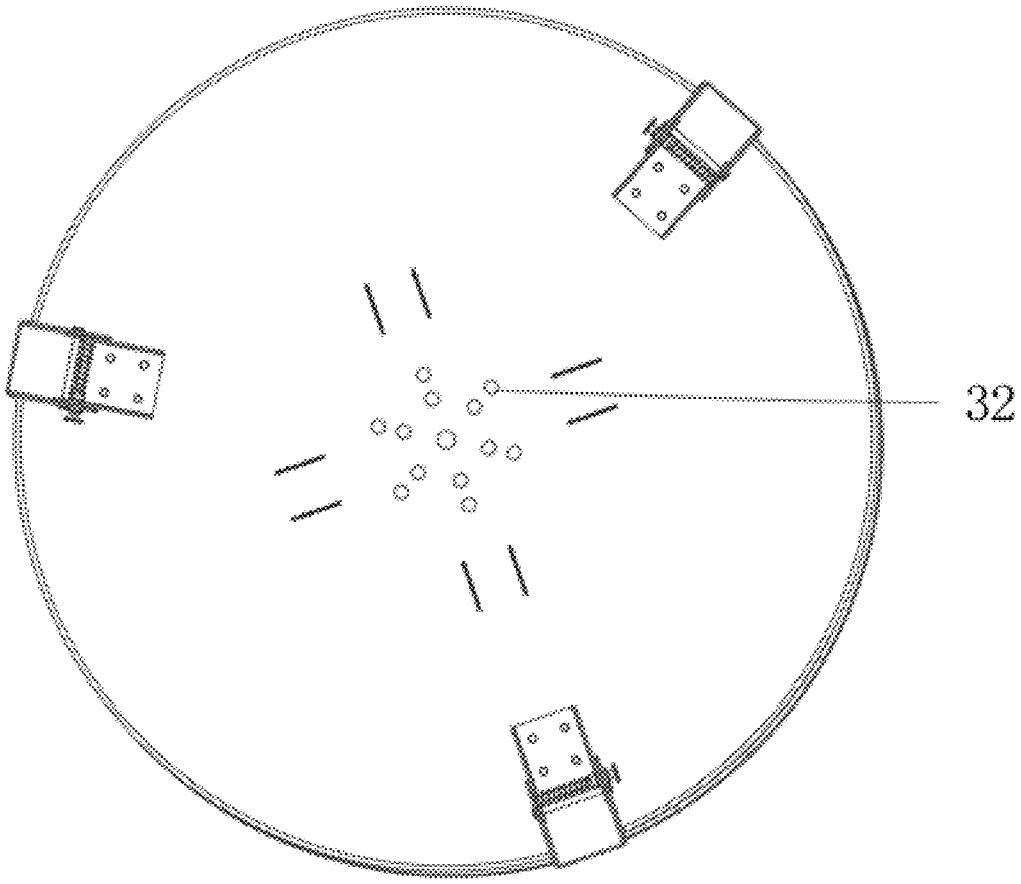
FIG. 8 is a schematic structural diagram of a base according to the present disclosure.

As shown in FIGS. 1 to 8, the top plate 2 is arranged at an upper portion of the main unit 1 and is detachably connected to the main unit 1. A support table 21 for supporting an object to be heated is provided at an upper portion of the top plate 2. An opening portion is arranged at the upper portion of the top plate 2. The object to be heated is placed on the support table 21 through the opening portion at the upper portion of the top plate 2 for heating. A mounting area is provided at a bottom of the top plate 2, and the top plate 2 abuts against an upper end portion of the main unit 1 through the mounting area and is sleeve-connected to the top plate 2. The base 3 is arranged at a lower portion of the main unit 1 and is detachably connected to the main unit 1. A supporting area 32 is provided at a top of the base 3. A lower end portion of the main unit 1 abuts against the inside of the supporting area 32 of the base 3 and is sleeve-connected to the base 3. The top plate 2 and the base 3 are both detachably connected to the main unit 1, which is convenient for assembly and disassembly. The supporting area 32 also helps to improve the overall stability.

As shown in FIGS. 1 to 8, a mounting area is provided at a bottom of the top plate 2, and the top plate 2 abuts against an upper end portion of the main unit 1 through the mounting area and is sleeve-connected to the top plate 2. The top plate 2 is arranged at the upper portion of the main unit 1 and is detachably connected to the main unit 1. The base 3 is arranged at the lower portion of the main unit 1 and is detachably connected to the main unit 1. The lower end portion of the main unit 1 abuts against the inside of the supporting area 32 of the base 3 and is sleeve-connected to the base 3. Such detachable connection design brings great convenience to the use of the wood stove. Such detachability not only facilitates daily use but also extends the service life of various components of the wood stove, and since a certain component can be maintained or replaced separately as needed, the entire stove is not needed to be discarded. Such sleeve-connection method is not only convenient for installation and disassembly, but also can effectively withstand the weight of objects on the support table 21 and various forces generated during the combustion, thereby ensuring the stability and reliability of the entire wood stove structure. The support table 21 for supporting the object to be heated is provided at the upper portion of the top plate 2. The support table 21 is usually made of a material with certain strength and heat resistance, such as stainless steel or special alloy. Its surface has been finely processed, is smooth and flat, and can provide a stable placement platform for various objects to be heated. Whether it is a pot, a kettle or other cooking utensils, they can be stably placed on the support table 21 for heating. The size and shape of the support table 21 will be optimized according to the overall design and usage requirements of the wood stove to ensure that it can meet the cooking needs of different users. An opening portion is arranged at the upper portion of the top plate 2, and the object to be heated is placed on the support table 21 through the opening portion at the upper portion of the top plate 2 for heating.

As shown in FIGS. 1 to 8, an upper end and a lower end of the main unit 1 are configured as opening structures. The upper end, a hollow chamber, and the lower end of the main unit 1 run through one another. The arrangement of the upper and lower openings facilitates storage after folding. When the main unit 1 is in a completely folded state, the hollow chamber inside forms a first storage chamber. When the main unit 1 is completely folded, the top plate 2 and the base 3 are detached from the main unit 1 and are placed into the first storage chamber from the open structure. At this time, an outer side wall of the main unit 1 abuts against a supporting medium.

As shown in FIGS. 1 to 8, when the main unit 1 is completely unfolded, the top plate 2 abuts against the upper portion of the main unit 1, and the base 3 abuts against the lower portion of the main unit 1 to form a stove. The stove abuts against the supporting medium through a support leg assembly 4. The combustion materials are placed in the second storage chamber through the opening portion of the top plate 2 or the opening structure of the main unit 1. After the combustion materials are placed on the supporting area 32 on the base 3 and ignited, the second storage chamber serves as a space for the combustion of the combustion materials, thereby providing a sufficient combustion space, stabilizing the combustion environment, and improving the combustion effect.

As shown in FIGS. 1 to 8, the upper end, the hollow chamber and the lower end of the main body unit 1 run through one another to form a continuous spatial channel. When the main unit 1 is completely folded, the hollow chamber inside the main unit is cleverly transformed into the first storage chamber. During the folding, the top plate 2 and the base 3 are first detached from the main unit 1. Due to the structural feature of the main unit 1 being open at the top and bottom, the detached top plate 2 and base 3 can be easily placed into the first storage chamber through the opening structure. At this time, the outer side wall of the main unit 1 will abut against the supporting medium, which can be of various types, thereby providing a stable supporting foundation for the main unit 1 in the folded storage state. Such folded storage method greatly saves space. Whether the wood stove is stored in a backpack or suitcase for outdoor travel, or is kept in a warehouse or in a corner of a home, it becomes very convenient and improves space utilization. The combustible materials can be placed in the second storage chamber through the opening portion of the top plate 2 or the opening structure of the main unit 1. The opening portion on the top plate 2 is cleverly designed, making it convenient for the user to put the combustible materials in, and also convenient for adding new combustible materials during the combustion. After the combustible materials are placed on the supporting area 32 on the base 3 and ignited, the second storage chamber plays the important role of a combustion space for the combustible materials. It provides a relatively independent and reasonable space for combustion. Sufficient combustion space allows the combustion materials to fully contact the air to promote the combustion reaction. The stable combustion environment is attributed to the rational structural design of the main unit 1, the top plate 2 and the base 3, which reduces the interference of external factors such as wind and dust during the combustion, and enables the flame to combust continuously and stably. This stable combustion environment helps to improve the combustion effect, make the combustion more complete, reduce the generation of smoke and harmful gases, and at the same time release more heat, thereby providing users with a more efficient and stable heat source to meet various needs such as outdoor cooking and heating.

As shown in FIGS. 1 to 8, a portable wood stove includes a foldable main unit 1, a top plate 2, and a base 3. The main unit 1 is composed of a plurality of groups of mounting plates that are adjacently connected and mutually rotate. Each of the mounting plates includes an inner side plate 5 and an outer side plate 6 that are detachably connected. The inner side plate 5 includes a first plate body and connecting portions respectively extending along both sides of the first plate body. The connecting portions are distributed along a length direction and there is at least one connecting portion. The adjacently arranged inner side plates 5 are rotationally connected to a connecting shaft 7 along the length direction through the connecting portions to ensure that the connecting shaft 7 runs through the entire height of the inner side plate 5 and the adjacent inner side plates 5 may rotate relative to each other. The connecting shaft 7 is run through the connecting portions of the adjacent inner side plates 5. The axial length of the connecting shaft 7 is completely identical to the entire height of the inner side plate 5 so that an upper end surface of the connecting shaft 7 is flush with an upper edge of the inner side plate 5, and a lower end surface of the connecting shaft 7 is flush with a lower edge of the inner side plate 5. The run-through structure ensures that the adjacent inner side plates 5 are evenly stressed along a height direction when rotating around the connecting shaft 7, avoiding deformation due to local stress concentration. When the main unit 1 is in the completely folded state and the completely unfolded state, a gap between the first side portion of the inner side plate 5 and the connecting shaft 7 forms a first anti-interference area to ensure that the when the inner side plate 5 is rotated to the fully folded state or fully unfolded state, there is no mechanical interference between the connecting portion and the connecting shaft 7. The connecting shaft 7 has a rotating shaft inside, which may rotate.

The first plate body has a first inner wall portion, a first outer wall portion, and a first side portion having two sides. The combustion chamber is composed of chambers formed inwardly by the several first inner wall portions. A second outer wall portion serve as an outer boundary of the outer side plate 6 and are in direct contact with the external environment. The second side portions are located on two side edges of the second plate body to play a role in connecting and defining. In order to realize a stable connection between the inner side plate 5 and the outer side plate 6, several run-through threaded holes are formed in the first plate body of the inner side plate 5. A barrier 61 is hollow inside. The inner side plate 5 is in bolted connection with the barrier 61 of the outer side plate 6 corresponding to the inner side plate. The inner side plates and the outer side plates are in one-to-one correspondence to ensure that the inner side plate 5 and the outer side plate 6 can be accurately and correspondingly connected. The inner side plate 5 is connected to the barrier 61 of the outer side plate 6 corresponding to the inner side plate by a bolt, and the inner side plates and the outer side plates are in one-to-one correspondence. The bolted connection method has the advantages of high connecting strength and good stability. In the process of using the wood stove, the wood stove is subjected to various forces, such as airflow impact generated in combustion and vibration in movement. The bolted connection can ensure that the inner side plate 5 and the outer side plate 6 are still tightly combined under the action of these forces, without loosing or separation, thereby ensuring the stability and the reliability of the entire structure of the wood stove. Meanwhile, the bolted connection also facilitates disassembly and assembly. When it is needed to clean, maintain or replace components of the wood stove, a user may separate the inner side plate 5 from the outer side plate 6 by disassembling the bolt, greatly improving the convenience of maintenance.

As shown in FIGS. 1 to 8, the support leg assembly 4 of the wood stove is arranged below the base 3. When in use, the support leg assembly 4 arranged below the base 3 is unfolded and stood on the ground, which can play a key role in stably supporting the entire stove. The support leg assembly 4 is generally composed of a plurality of support legs, which can be made of a metal material, such as stainless steel or cast iron, to ensure that they have sufficient strength and durability to withstand the weight of the wood stove and the combustion materials therein. By arranging the assembly, when the wood stove is moved or placed, it will not cause excessive wear on the ground or other contact surfaces, and increase the friction with the ground to prevent the wood stove from slipping due to external forces during the use. A ventilation area is formed between a bottom of the support leg assembly 4 and a bottom of the base 3. Several evenly distributed base air inlet holes 31 are provided at the bottom of the base 3. The ventilation area and the base air inlet holes 31 communicate with each other to form an air inlet channel for the full combustion of firewood in the stove. Through the direct contact between the overhead main unit 1 and the ground and the arrangement of the ventilation area and the base air inlet holes 31, sufficient oxygen can be provided to promote the full combustion of the firewood. Good air circulation and full combustion can create a relatively stable combustion environment and prevent overheating.

As shown in FIGS. 1 to 8, a circumferential area of an inner wall of the inner side plate 5 forms an enclosing portion that wraps the combustion materials therein and provides a relatively concentrated space for combustion. The core of ventilation lies in the design of the secondary heating channel. A lower secondary air inlet hole 62 is provided on a lower side wall of the outer side plate 6, and an upper secondary air inlet hole 52 is provided on an upper side wall of the inner side plate 5, and these two, together with the air inlet channel, jointly constitute the secondary heating channel of the combustion-supporting stove. During the combustion, the primary air inlet only provides oxygen to the combustion materials from the bottom. As the combustion proceeds, the oxygen in the upper layer of the stove is gradually exhausted, resulting in that the firewood at the upper layer is not fully combusted. At this time, air enters from the lower secondary air inlet hole 62 at the lower portion of the outer side plate 6 and is heated during the flowing in the air inlet channel. The heated air is not easy to lower the temperature of the flue gas, thereby reducing the minimum combustible concentration of the flue gas. The hot air then enters the combustion area through the upper secondary air inlet hole 52 at the upper portion of the inner side plate 5, thereby replenishing the oxygen lacking in the upper layer to enable the firewood at the upper layer to be fully combusted, and increasing the combustion efficiency of the fuel. Finally, it should be noted that: the above embodiments are merely used to illustrate the technical solutions of the present disclosure, rather than to limit them. Although the present disclosure is described in detail with reference to the foregoing embodiments, those of ordinary skill in the art should understand that: they can still modify the technical solutions described in the foregoing embodiments, or make equivalent substitutions for some of the technical features therein; and these modifications or substitutions do not cause the essence of the corresponding technical solutions to deviate from the scope of the technical solutions of the respective embodiments of the present disclosure.

In short, the above description is only a preferred embodiment of the present disclosure, and equivalent changes and modifications made according to the scope of the application patent of the present disclosure should fall within the scope of the patent of the present disclosure.

What is claimed is:

1. A portable wood stove, comprising:

a foldable main unit (1), wherein the main body unit (1) is composed of a plurality of groups of mounting plates that are adjacently connected and mutually rotate, the main unit (1) has a combustion chamber, and the combustion chamber is defined inwardly by the mounting plates;

a top plate (2) arranged at an upper portion of the main unit (1) and detachably connected to the main unit (1), wherein a support table for supporting an object to be heated is provided at an upper portion of the top plate (2), and an opening portion is arranged at the upper portion of the top plate (2);

a base (3) arranged at a lower portion of the main unit (1) and detachably connected to the main unit (1), and a support leg assembly (4) arranged below the base (3), wherein an upper end and a lower end of the main unit (1) are configured as opening structures; the upper end, a hollow chamber, and the lower end of the main body unit (1) run through one another; when the main unit (1) is in a completely folded state, the hollow chamber inside forms a first storage chamber; when the top plate (2) and the base (3) are placed in the first storage chamber, at least a portion of structures of the top plate (2) and the base (3) is located in the first storage chamber; when the main unit (1) is in a fully unfolded state, a second storage chamber is formed by an area among the main unit (1), the top plate (2) and the base (3), which is used for combustion of combustion materials;

wherein when the main unit (1) is completely folded, the top plate (2) and the base (3) are separated from the main unit (1); when the first storage chamber performs storage, an outer side wall of the main unit (1) abuts against a supporting medium, and the top plate (2) and the base (3) extend into the first storage chamber through the opening structure for storage;

wherein when the main unit (1) is completely unfolded, the top plate (2) abuts against the upper portion of the main unit (1), and the lower portion of the main unit (1) abuts against the base (3) to form a stove, and the stove abuts against the supporting medium through the support leg assembly (4), and the combustion materials are placed in the second storage chamber through the opening portion of the top plate (2) or the open structure of the main unit (1);

wherein the mounting plate comprises an inner side plate (5) and an outer side plate (6) that are detachably connected, and a circumferential area of an inner wall of the inner side plate (5) forms an enclosing portion that wraps the combustion materials for full combustion of the combustion materials, and a gap is formed between the outer side plate (6) and the inner side plate (5) to form an air inlet channel for secondary combustion;

wherein the inner side plate (5) comprises a first plate body and connecting portions respectively extending along both sides of the first plate body; the connecting portions are distributed along a length direction and there is at least one connecting portion; the connected inner side plates (5) are rotationally connected to a connecting shaft (7) along the length direction through the connecting portions so that the adjacently arranged the inner side plates (5) are rotationally connected to each other;

the connecting shaft (7) runs through the entire height of the inner side plate (5) and is equivalent to the height of the inner side plate (5);

the first plate body has a first inner wall portion, a first outer wall portion, and a first side portion having two sides, and the combustion chamber is composed of chambers formed inwardly by the several first inner wall portions; and after the inner side plate (5) and the connecting shaft (7) are connected and rotate relative to each other, the main unit (1) forms a folded state and an unfolded state, when the main unit (1) is in the completely folded state and the completely unfolded state, a gap between the first side portion of the inner side plate (5) and the connecting shaft (7) forms a first anti-interference area.

2. The portable wood stove according to claim 1, wherein a mounting area is provided at a bottom of the top plate (2), and the top plate (2) abuts against an upper end portion of the main unit (1) through the mounting area and is sleeve-connected to the top plate (2); and a supporting area is provided at a top of the base (3), and a lower end portion of the main unit (1) abuts against an inside of the supporting area of the base (3) and is sleeve-connected to the base (3).

3. The portable wood stove according to claim 1, wherein a ventilation area is formed between a bottom of the support leg assembly (4) and a bottom of the base (3), and a base air inlet hole is provided at the bottom of the base (3), and the ventilation area and the base air inlet hole communicate with each other to form an air inlet channel for full combustion of firewood in the stove.

4. The portable wood stove according to claim 1, wherein the outer side plate (6) is located outside the first outer wall portion of the inner side plate (5), the outer side plate (6) comprises a second plate body and a barrier, the second plate body has a second inner wall portion, a second outer wall portion, and a second side portion having two sides, the barrier is formed by protruding from the second inner wall portion, and the outer side plate (6) is connected to the inner side plate (5) through the second plate body or the barrier is connected to the first plate body of the inner side plate (5); and the air inlet channel is composed of a through space between the first outer wall portion and the second inner wall portion.

5. The portable wood stove according to claim 4, wherein the outer side plate (6) further comprises a supporting portion formed from flanges of the second side portion, and the supporting portion has an outer side portion;

after the outer side plate (6) and the inner side plate (5) are connected and rotate as a whole relative to the connecting shaft (7), the main unit (1) forms a folded state and an unfolded state, and when the main unit (1) is in the completely folded state or the completely unfolded state, a gap between the second side portion of the outer side plate (6) or the outer side portion of the supporting portion and the connecting shaft (7) forms a second anti-interference area.

6. The portable wood stove according to claim 1, wherein a lower secondary air inlet hole (62) is provided on a lower side wall of the outer side plate (6), an upper secondary air inlet hole (52) is provided on an upper side wall of the inner side plate (5), and an area from the lower secondary air inlet hole (62) to the air inlet channel to the upper secondary air inlet hole (52) forms a secondary heating channel of a combustion-supporting stove.

* * * * *